US006539991B1

(12) United States Patent
Ackerman

(10) Patent No.: US 6,539,991 B1
(45) Date of Patent: Apr. 1, 2003

(54) PAINT CAN SPILL GUARD

(76) Inventor: Jim Ackerman, P.O. Box 602, Chipley, FL (US) 32428

( * ) Notice: Subject to any disclaimer, the term of this patent is extended or adjusted under 35 U.S.C. 154(b) by 0 days.

(21) Appl. No.: 10/090,973

(22) Filed: Mar. 5, 2002

(51) Int. Cl.[7] ..... B65B 1/04
(52) U.S. Cl. ..... 141/331; 141/311 A; 220/733
(58) Field of Search ..... 220/570, 571.1, 220/731, 733; 141/331–345, 311 A, 98

(56) References Cited

U.S. PATENT DOCUMENTS 2,868,246 A * 1/1959 Nelson ..... 141/286
3,693,829 A * 9/1972 Price ..... 220/698
5,213,239 A * 5/1993 Macaluso ..... 222/567

* cited by examiner

*Primary Examiner*—Steven O. Douglas
(74) *Attorney, Agent, or Firm*—Michael I Kroll

(57) ABSTRACT

A device for positioning on the top of a liquid storage can to assist in the transfer of liquids, such as paint, in and out of the can, while simultaneously isolating the can top rim channel from the liquid being transferred. An engaging member on the device is received by the can rim channel to seal off the rim channel.

5 Claims, 9 Drawing Sheets

PAINT CAN SPILL GUARD

BACKGROUND OF THE INVENTION

1. Field of the Invention

The present invention relates generally to spill guards and, more specifically, to a paint bucket spill guard that is installed on a paint bucket for the purpose of preventing paint from collecting in the paint can rim channel. The conical shape of the device provides a large opening for dispensing the paint from the paint can as well as pouring the paint back into the paint can as from a roller tray.

2. Description of the Prior Art

Normally, when applying paint by brush, the tendency is to extract excess paint by wiping the brush on the paint can interior rim. This often causes an undesirable accumulation in the paint can rim channel, interfering with the hermetic seal of the paint can lid, rendering long term storage useless. Ordinary funnels, spouts and caps do not address this problem. What is needed is a device that provides the pouring functions of a funnel, that also has the capability to isolate the paint can rim channel from the paint or other liquid.

SUMMARY OF THE PRESENT INVENTION

A primary object of the present invention is to provide a paint bucket spill guard that is installed on a paint bucket for the purpose of preventing paint from collecting in the paint can rim channel.

Another object of the present invention is to provide a conical shaped device providing a larger opening for dispensing the paint from the paint can as well as pouring the paint back into the paint can as from a roller tray.

Yet another object of the present invention is to provide two lifting tabs aligned with the uppermost horizontal surface, positioned roughly 180 degrees apart.

Still yet another object of the present invention is to provide tabs that serve to facilitate positioning the device atop a paint can and also to allow convenient removal without having to come in contact with the surfaces that may contain wet paint.

Another object of the present invention is to provide a paint bucket spill guard that provides an inner work surface.

Yet another object of the present invention is to provide a paint bucket spill guard conveniently sized to overlap the paint can rim channel structure so as to further prevent possibility of contamination.

Additional objects of the present invention will appear as the description proceeds.

The present invention overcomes the shortcomings of the prior art by providing a paint bucket spill guard that is installed on a paint bucket for the purpose of preventing paint from collecting in the paint can rim channel. Also, the conical shape of the device provides a larger opening for dispensing the paint from the paint can as well as pouring the paint back into the paint can as from a roller tray. Also, having two lifting tabs aligned with the uppermost horizontal surface positioned roughly 180 degrees apart that serves to facilitate positioning of the device atop a paint can, and also allows convenient removal without having to come in contact with the surfaces that may contain wet paint.

There is provided a device for guiding a liquid into a liquid storage can having a top and a top opening, the top having a rim about the opening, the rim having an upwardly facing shoulder and an upwardly facing channel, the device comprising: a wall portion forming an open enclosure, the wall portion having a bottom end, the wall portion enclosure opening through the bottom end; a flange portion on the wall portion bottom end, the flange portion having a downwardly facing shoulder and a downwardly facing engaging member, the engaging member being received by the liquid storage can rim channel about the rim circumference, such that the downwardly facing shoulder bears upon the rim shoulder and, when the liquid is poured into the device, the wall portion directs the liquid through the wall portion enclosure opening, and the flange portion isolates the liquid storage can rim channel from the liquid.

In one embodiment, the liquid storage can rim channel further comprises an inner lip and the flange portion further comprises a downwardly facing inner shoulder, the inner shoulder being inwardly disposed from the engaging member, such that the inner shoulder bears upon the rim channel inner lip when the engaging member is received by the rim channel.

In one embodiment, the liquid storage can rim channel further comprises an inner lip and the engaging member further comprises an inner side, the inner side being tapered such that the engaging member inner side bears upon the rim channel inner lip when the engaging member is received by the rim channel, the joinder of the inner side and inner lip isolating the liquid storage can rim channel from the liquid.

In one embodiment, the liquid storage can is a paint can, and the liquid is paint.

In one embodiment, the engaging member is closely received by the liquid storage can rim channel.

In one embodiment, the wall portion has at least one grasping extension.

In one embodiment, the wall portion has a pair of grasping extensions.

In one embodiment, the wall portion is conical.

There is provided, in combination with a liquid storage can having a top and a top opening, the top having a rim about the opening, the rim having an upwardly facing shoulder and an upwardly facing channel, a device for guiding the liquid into the liquid storage can top opening, the device comprising: a wall portion forming an open enclosure, the wall portion having a bottom end, the wall portion enclosure opening through the bottom end; a flange portion on the wall portion bottom end, the flange portion having a downwardly facing shoulder and a downwardly facing engaging member, the engaging member being received by the liquid storage can rim channel about the rim circumference, such that the downwardly facing shoulder bears upon the rim shoulder and, when the liquid is poured into the device, the wall portion directs the liquid through the wall portion enclosure opening, and the flange portion isolates the liquid storage can rim channel from the liquid.

A device is provided for guiding a liquid into a liquid storage can having a top and a top opening, the top having a rim about the opening, the rim having an upwardly facing shoulder and an upwardly facing channel, the device comprising: a wall portion forming an open enclosure, the wall portion having a bottom end, the wall portion enclosure opening through the bottom end; flange means for positioning the wall portion bottom end in the rim channel such that the rim channel is isolated from liquid being poured through the wall portion enclosure opening into the liquid storage can.

A device is provided for guiding liquid paint into a paint can having a top and a top opening, the top having a rim about the opening, the rim having an upwardly facing shoulder, an upwardly facing channel, and an inner lip, the device comprising: a wall portion forming an open, conical enclosure, the wall portion having at least two grasping extensions and a bottom end, the wall portion enclosure opening through the bottom end; a flange portion on the wall portion bottom end, the flange portion having a downwardly facing outer shoulder, a downwardly facing inner shoulder and a downwardly facing engaging member, the engaging member being received by the paint can rim channel about the rim circumference such that the outer shoulder bears upon the rim channel shoulder, the inner shoulder bears upon the rim channel inner lip and, when the paint is poured into the device, the wall portion directs the paint through the wall portion enclosure opening, and the flange portion isolates the paint can rim channel from the paint.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of the present invention in use. Shown is the present invention installed on a paint can for the purpose of preventing paint from collecting in the paint can rim channel. Additionally the conical shape of the device provides a larger opening for dispensing the paint from the paint can as well as pouring the paint back into the paint can as from a roller tray.

FIG. 2 is an illustrative view of the present invention in use. Shown is the installed device being used in a typical paint application process. Normally, when applying paint by brush, the tendency is to extract excess paint by wiping the brush on the paint can interior rim. This often causes an undesirable accumulation in the paint can rim channel, interfering with the hermetic seal of the paint can, rendering long term storage useless. The conical shaped device of the present invention seals the paint lid-closing channel while providing an edge and interior work surface.

FIG. 3 is a perspective view of the present invention. The present invention has two lifting tabs aligned with the uppermost horizontal surface positioned roughly 180 degrees apart. These serve to facilitate positioning of the device atop a paint can and also to allow convenient removal without having to come in contact with the surfaces that may contain wet paint.

FIG. 4 is a top view of the present invention. The lower base of the device contains an aperture allowing for passage of paint into and out of the paint can. It is conveniently sized to overlap the paint can rim channel structure so as to further prevent possibility of contamination.

Figure 8:
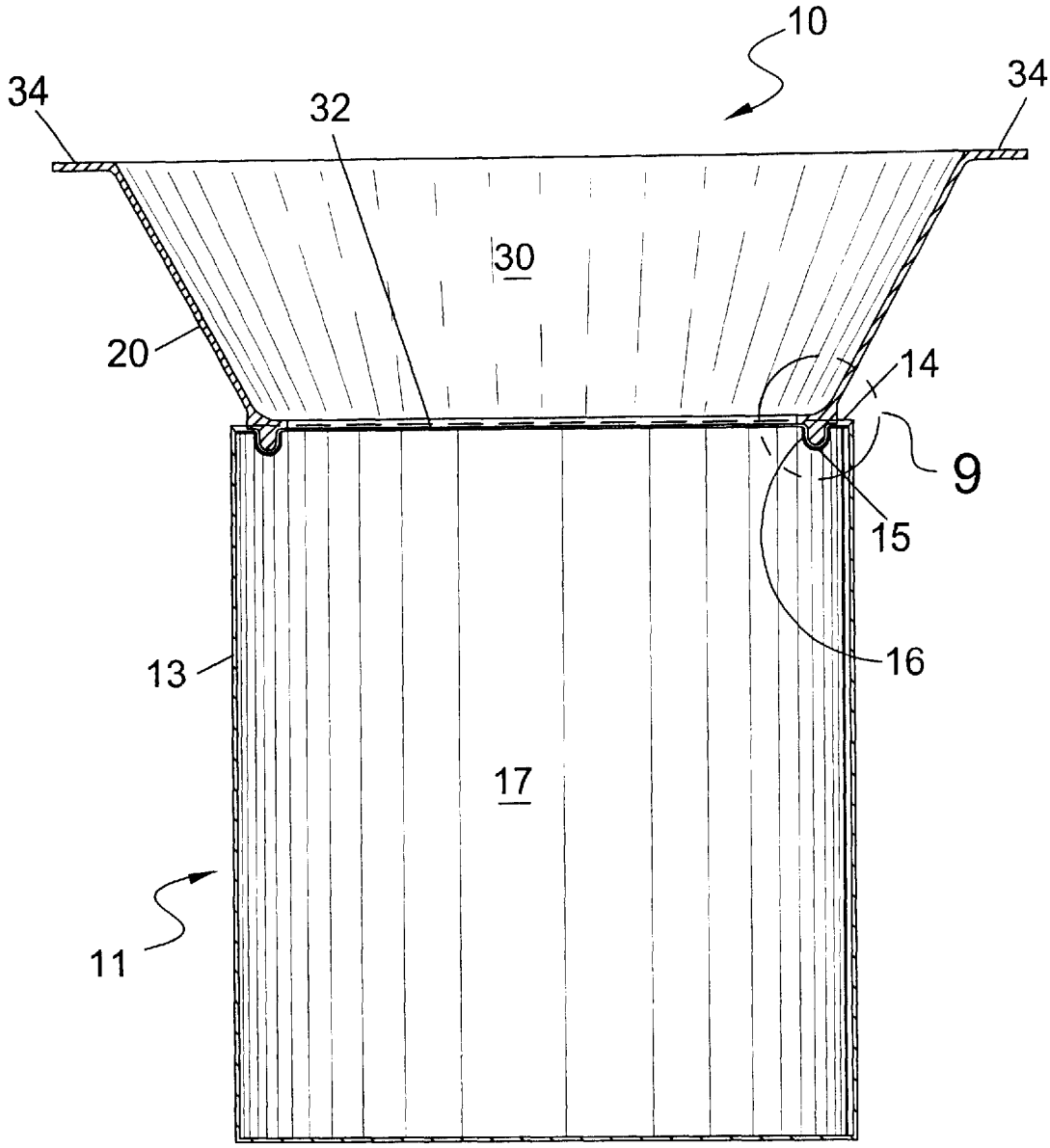

FIG. 8 is a cross sectional view of the present invention in use. Shown is a cross sectional view of the present invention mounted on a typical paint can, whereupon the conical shape of the invention increases the effective opening of the paint can. In addition, the engaging member of the invention is seated in the rim channel preventing paint from accumulating in the rim channel.

Figure 9:
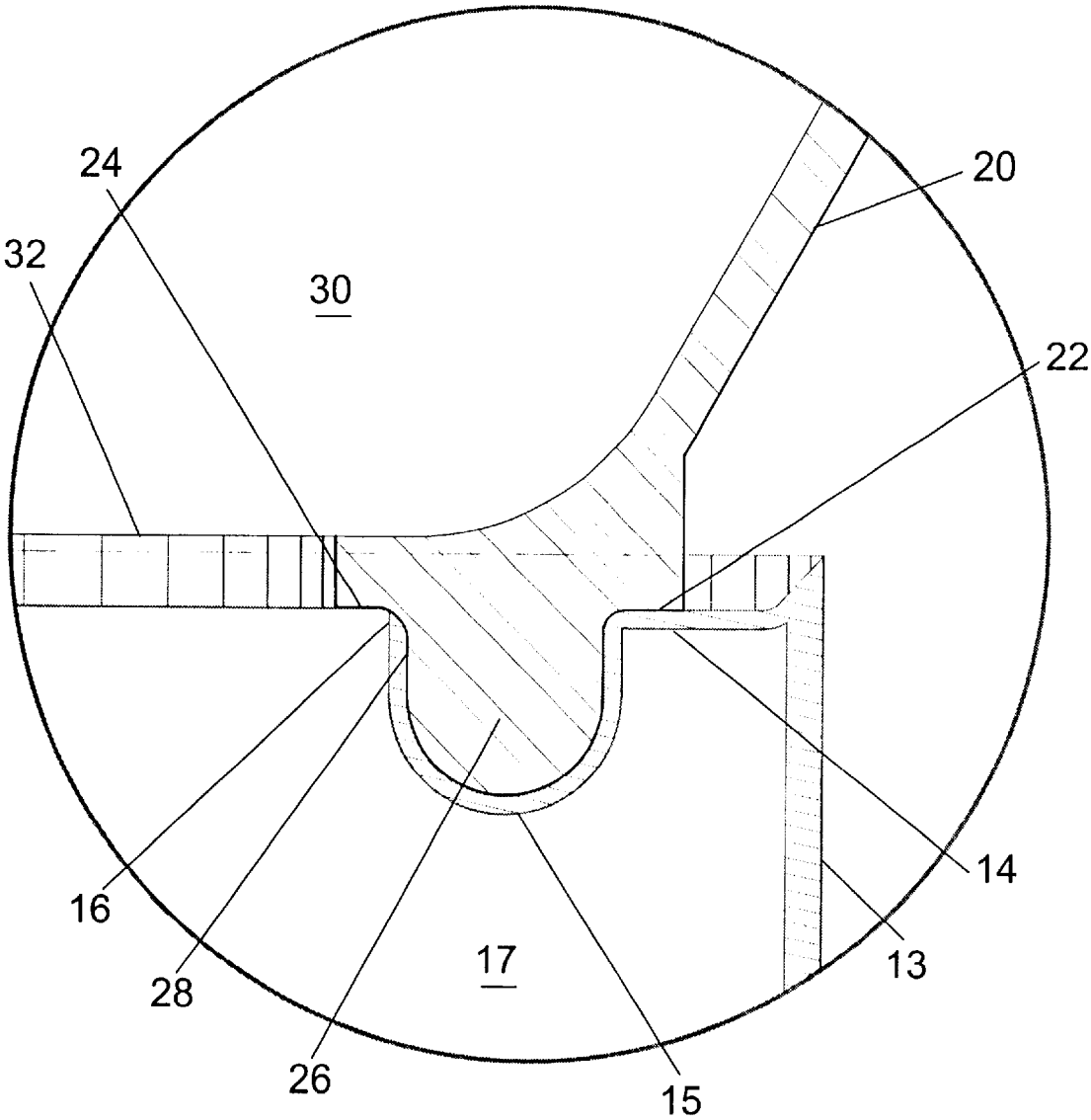

FIG. 9 is an enlarged view of the conical device flange portion shown in mating position with the paint can rim channel. The engaging member and shoulders of the flange portion form a mating seal with the paint can rim channel thereby no paint can enter said channel. The flange at the base of the device is sized to extend beyond the innermost lip of the paint can rim channel whereby any paint on the walls will drip into the interior of the can instead of running down the sides.

DESCRIPTION OF THE REFERENCED NUMERALS

Turning now descriptively to the drawings, in which similar reference characters denote similar elements throughout the several views, the figures illustrate the Paint Can Spill Guard of the present invention. With regard to the reference numerals used, the following numbering is used throughout the various drawing figures.

10 Paint Can Spill Guard of the present invention
11 paint can
12 paint
13 paint can outer side
14 paint can rim shoulder
15 paint can rim channel
16 paint can rim inner lip
17 paint can interior
18 paint brush
20 paint can spill guard wall
22 outer shoulder
24 inner shoulder
26 engaging member
28 engaging member tapered side
30 spill guard interior
32 spill guard opening
34 lift tabs

DETAILED DESCRIPTION OF THE INVENTION

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

As shown in FIGS. 1–9, the spill guard 10 is specially adapted to be installed on the typical paint can 11 holding paint 12. The paint can 11 has an outer side 13 which may be round or otherwise. The paint can 11 has a rim shoulder 14 extending radially inwardly on the top of the can 11, with a rim channel 15 disposed inwardly from the rim shoulder 14. The rim channel 15 has an inner lip 16 that generally forms the perimeter of the paint can 11 opening to the paint can interior 17.

Figure 2:
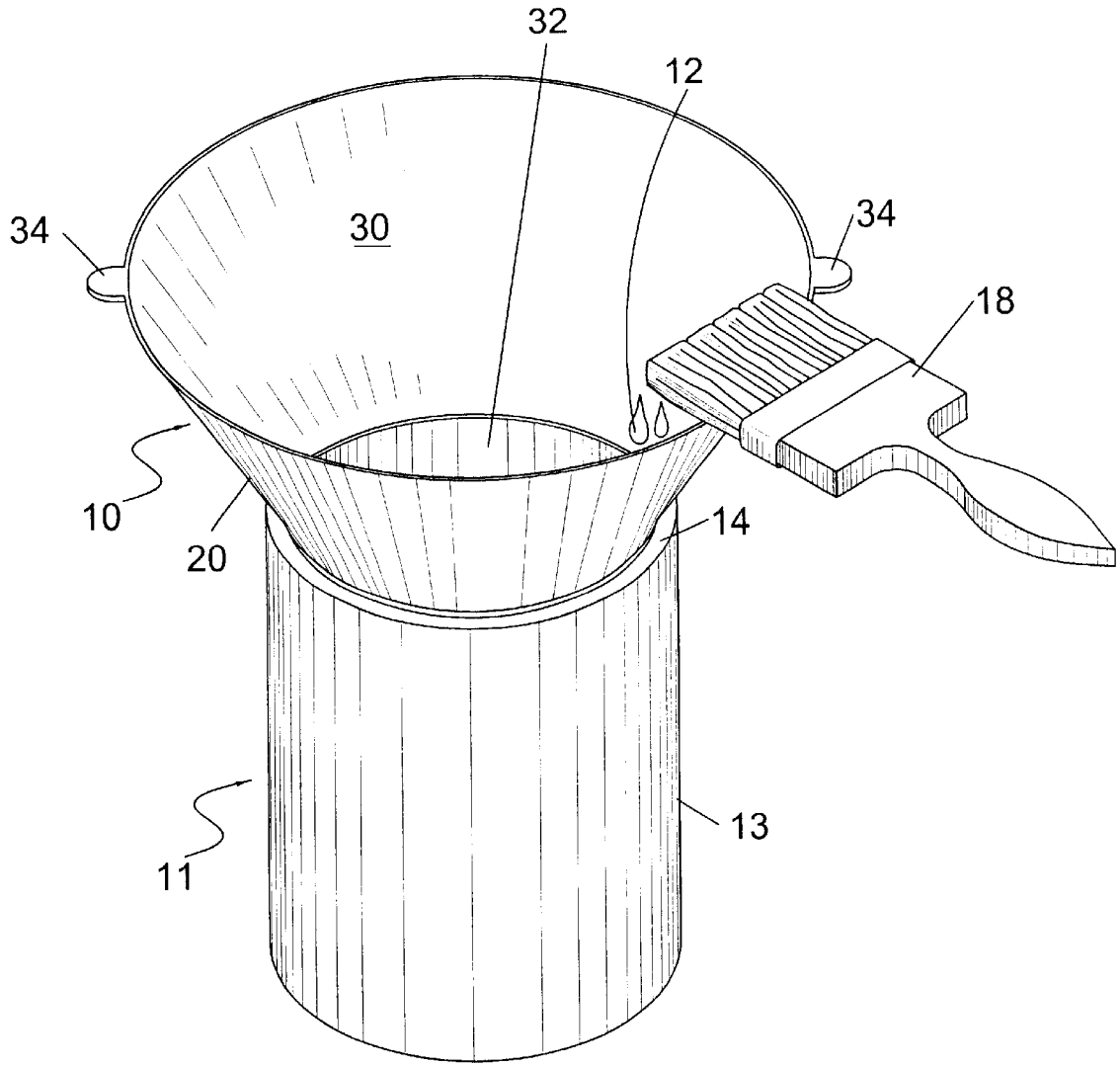
Figure 3:
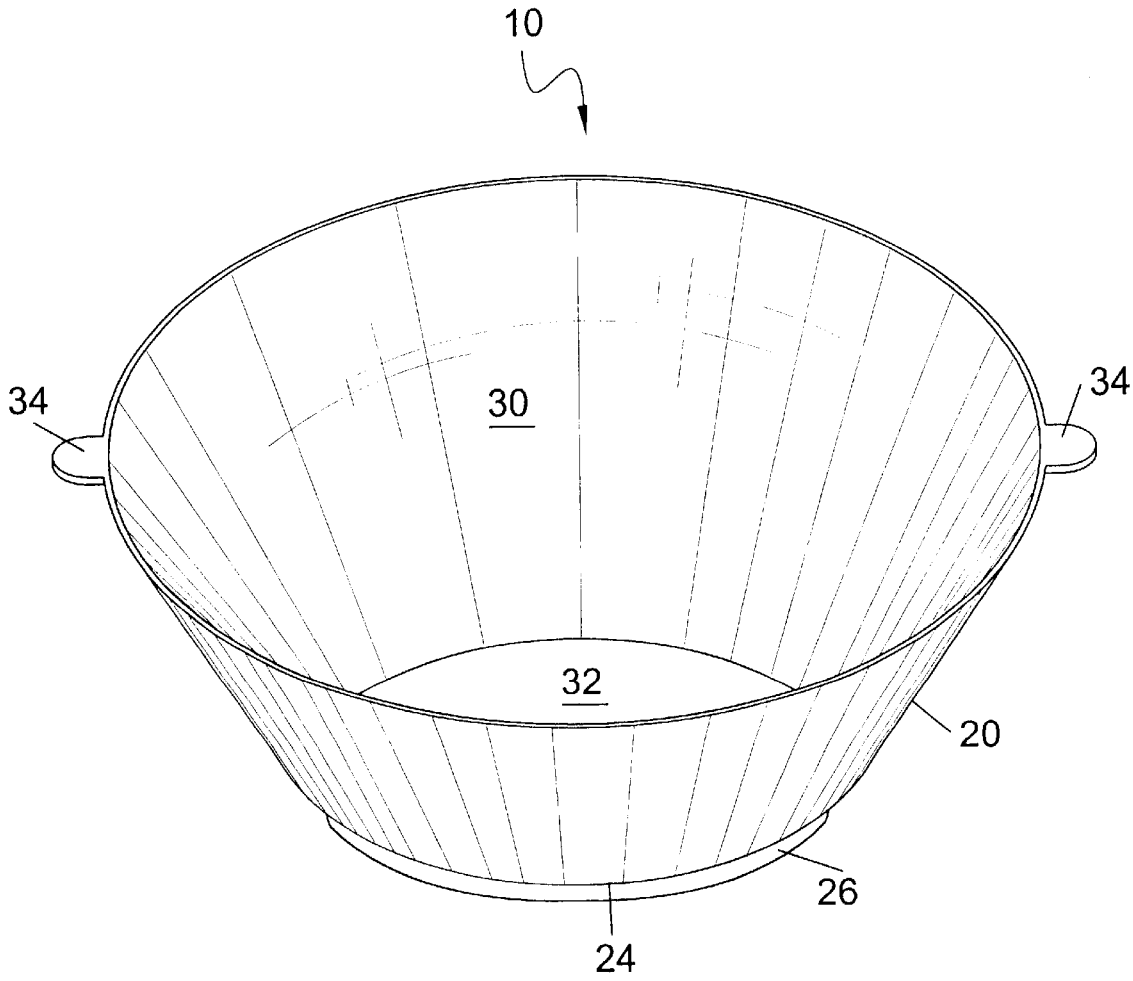
Figure 4:
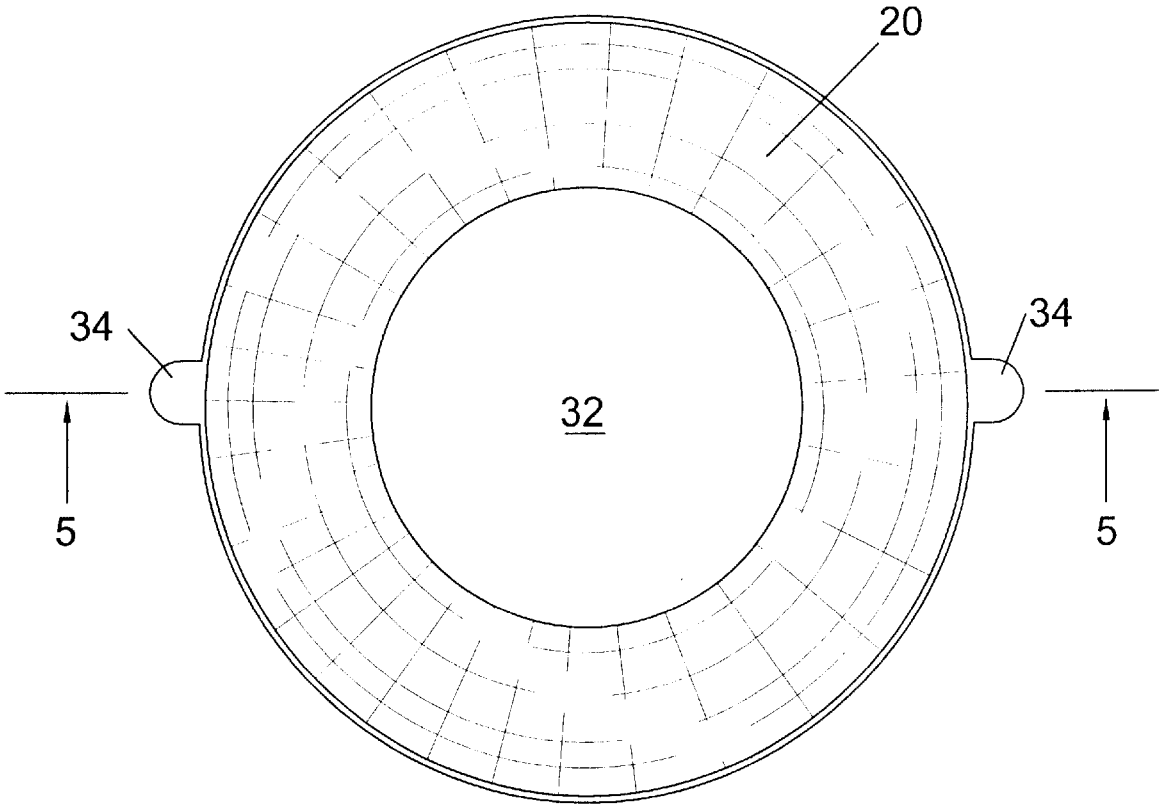

As shown in FIG. 2, a paint brush 18 is typically used and the brush 18 is often wiped free of loose paint 12. Prior to the present invention this wiping usually occurred on the paint can 11 itself, leaving paint 12 in the rim channel 15.

To avoid paint 12 accumulations the rim channel 15, it is necessary to isolate the paint 12 from the rim channel 15. The spill guard 10 of the present invention has a wall portion 20 that is generally conical, and has a flange portion at the lower end with an outer shoulder 22, as shown particularly in FIG. 9. This outer shoulder 22 follows the circumference of the paint can 11 rim, and abuts the paint can rim shoulder 14.

Similarly, the spill guard 10 flange portion has a inner shoulder 24 and an engaging member 26, with the engaging member 26 being closely received by the paint can rim channel 15, and the inner shoulder 24 abutting the rim channel inner lip 16. The engaging member 26 has an inner side 28.

Figure 1:
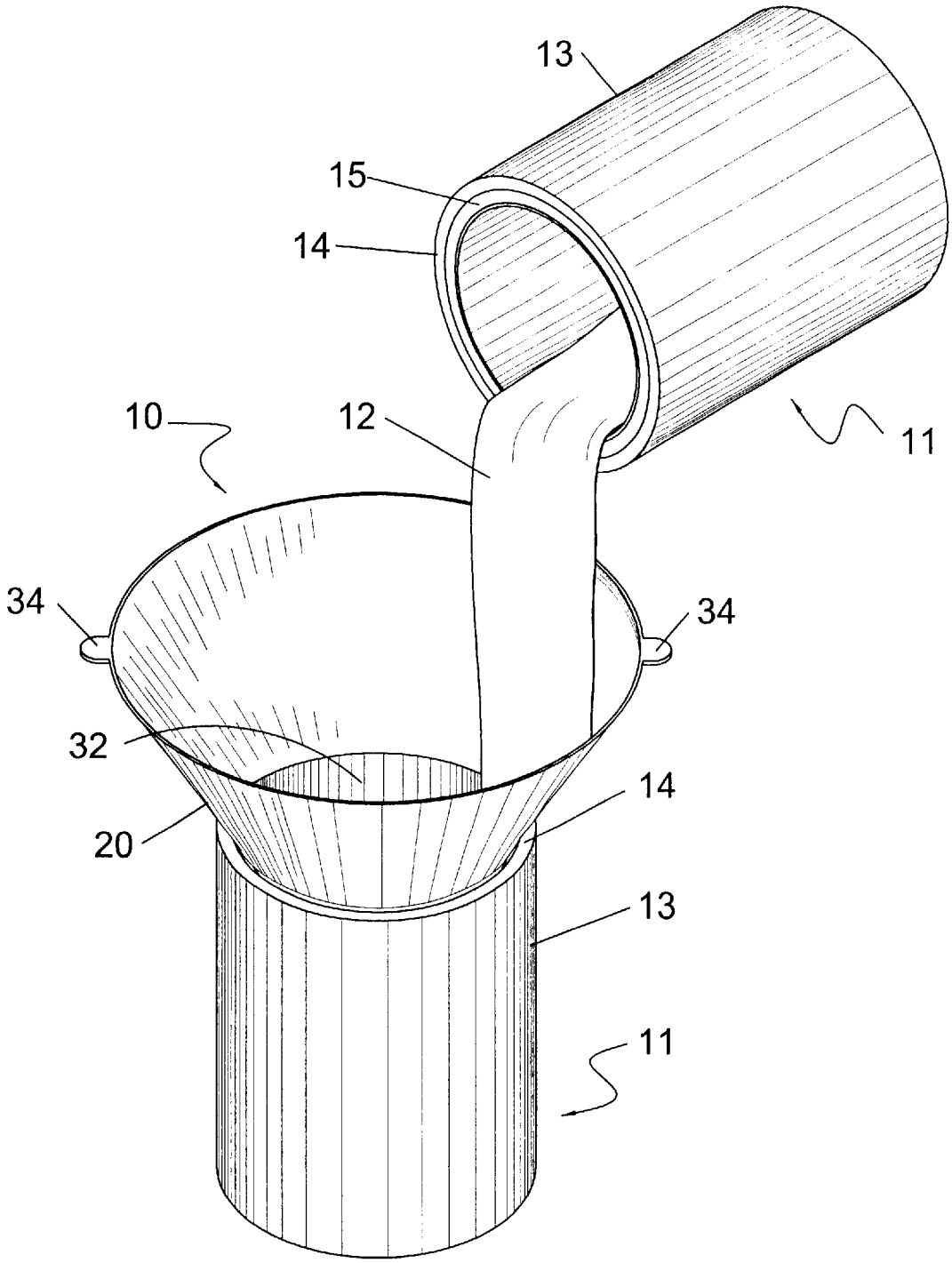
Figure 6:
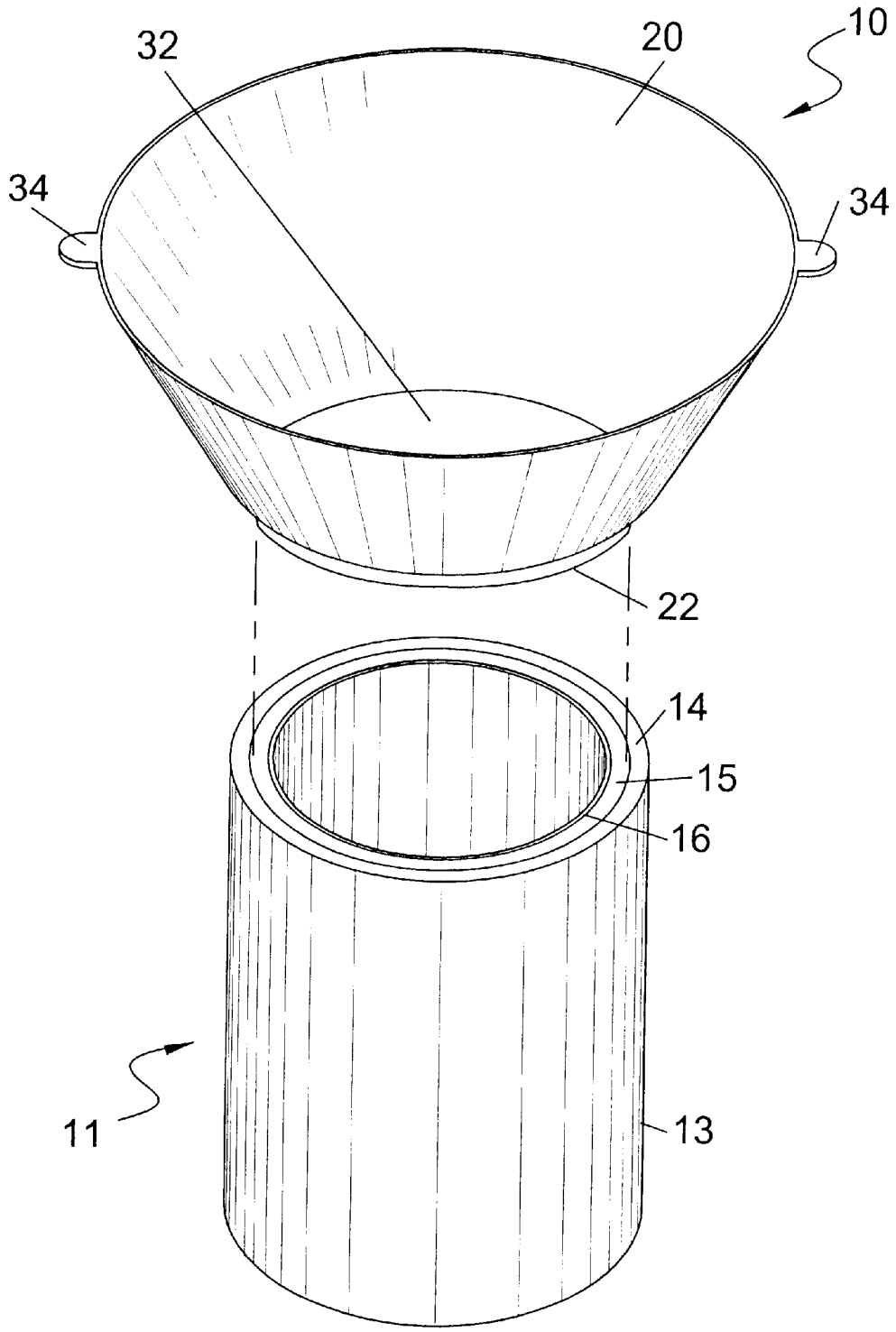
FIG. 6 is a perspective view of the present invention with paint can positioned immediately beneath. The present invention has a flange portion conforming substantially to the paint can rim channel thereby forming a seal with the paint can.
Figure 7:
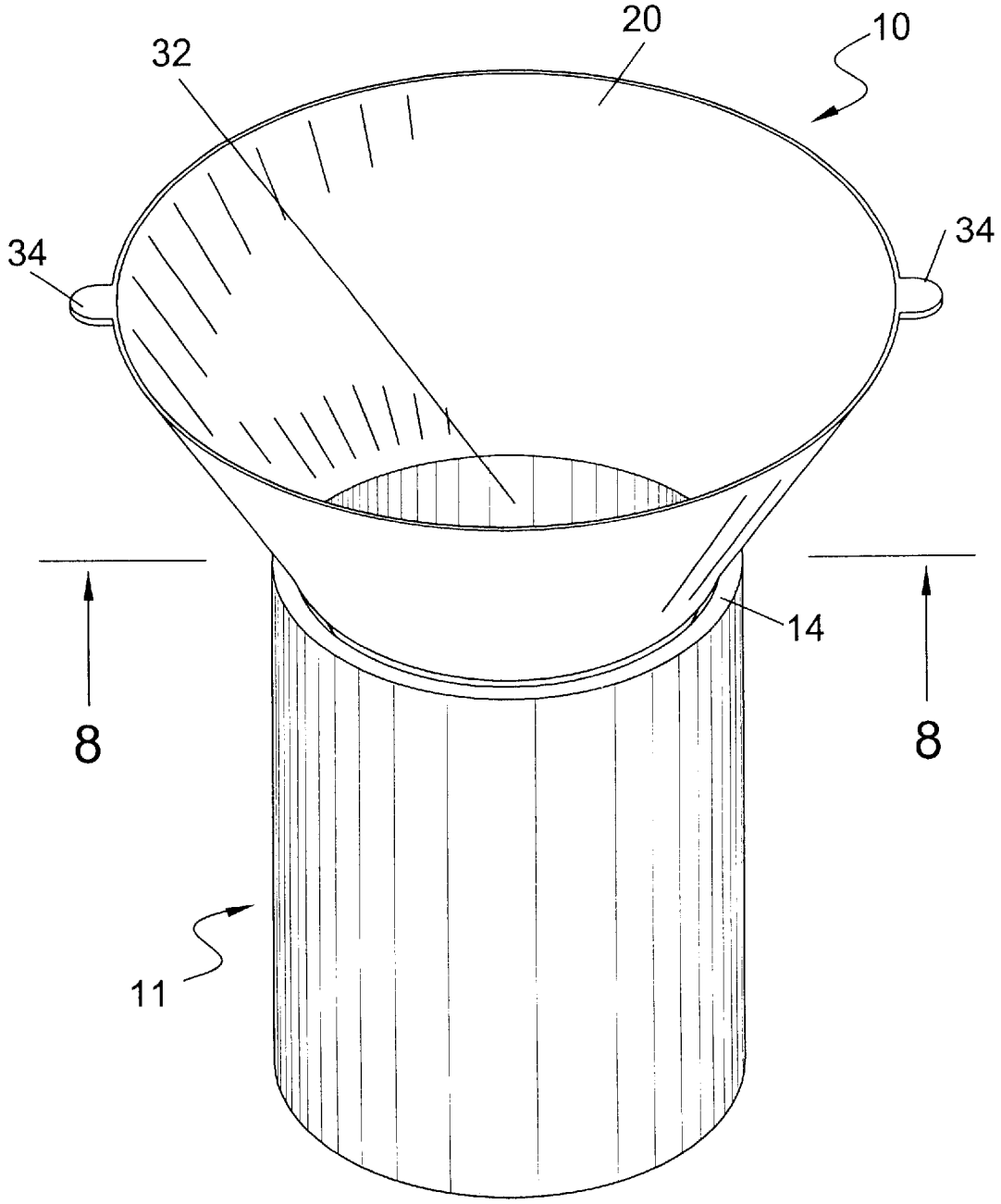
FIG. 7 is a perspective view of the present invention in operating position atop a paint can. Shown is the conical device having oppositely opposed tabs located on the upper periphery acting as handles for attaching and removing the device from a paint can.

As shown in FIGS. 6–7, the spill guard 10 is lowered directly onto the paint can 11. When so lowered, FIGS. 8–9 show the engaging member 26 seating in the paint can rim channel 15, the outer shoulder 22 abutting the paint can rim shoulder 14, and the inner shoulder 24 abutting the rim channel inner lip 16. This seat isolates the rim channel 15 from paint 12 as the paint 12 shakes, or is wiped, from the brush 18, as shown in FIG. 2. This isolation is also maintained as the paint 12 is poured into the spill guard interior 30 and on through the spill guard opening 32 into the paint can 11, as shown in FIG. 1.

The seating of the spill guard 10 flange portion in the rim channel 15 also prevents paint 12 from missing the paint can 11 and causing a spill generally.

Figure 5:
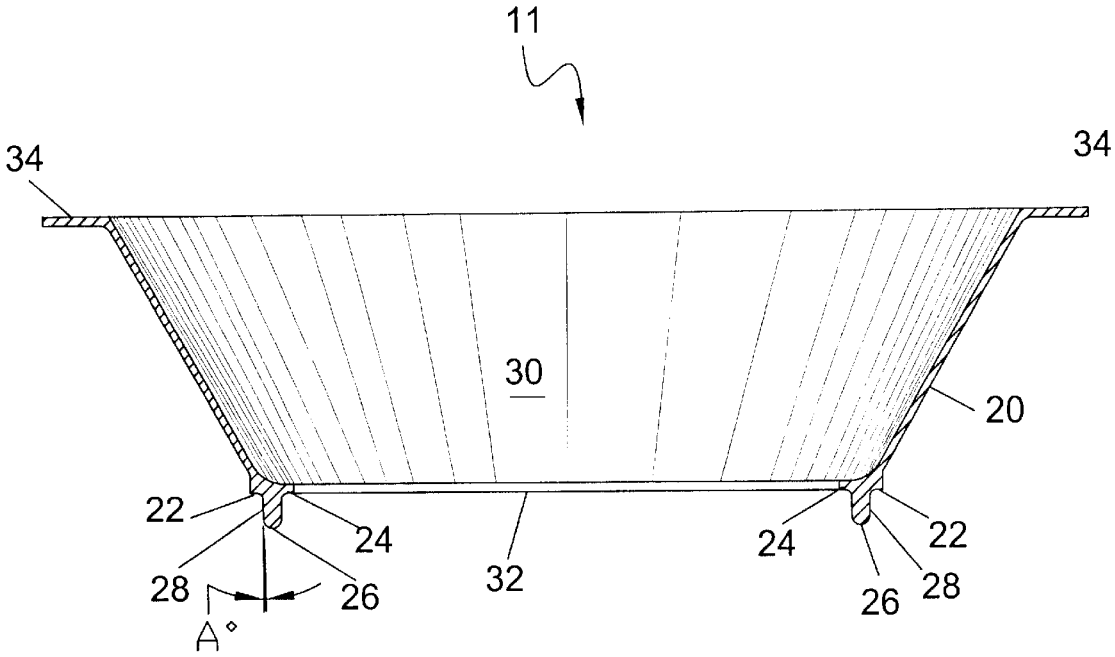
FIG. 5 is a cross sectional view of the conical device of the present invention. Shown is the exterior side of the paint can closure channel engaging member having a slope whereby the engaging member has a tapered side so that the engaging member will seat within the channel even though the channel may differ in distance across the rim of the channel.

As shown in FIG. 5, a slight radially outward taper, of angle A, is present on the engaging member inner side 28. This optional taper accommodates small variations in the width of the rim channel 15, ensuring that the rim channel 15 is isolated even in situations when the rim channel 15 is slightly smaller than the full width of the engaging member 26.

Generally planar lifting tabs 34 extend from the wall 20 in diametric opposition. The tabs 34 provide a convenient grasping point to lift or otherwise hold the spill guard 10. The tabs 34 are of sufficient size to keep the hands away from the wall 20 and the spill guard interior 30, to assist in keeping the hands free from paint 12.

In another embodiment, the engaging member extends generally upwardly to the wall, while continuing to positively displace the rim channel 15. In this embodiment, the inner shoulder 24 is eliminated.

With respect to the above description then, it is to be realized that the optimum material and dimensional relationships for the parts of the Paint Can Spill Guard 10, will include variations in size, materials, shape, and form, which will occur to those skilled in the art upon review of the present disclosure. For example, the spill guard 10 is constructed from various woods, metals and plastics, either in a single piece or in individual components. In other embodiments, the flange portion engaging member is configured to accommodate non-circular paint cans, with the wall remaining generally conical, or changing to correspond to the non-circular paint can configuration. The spill guard 10 is also readily adapted to other liquid storage cans having a rim shoulder and a rim channel, as well. All equivalent relationships to those illustrated in the drawings and described in the specification are intended to be encompassed by the present invention.

What is claimed as new and desired to be protected by Letters Patent is set forth in the appended claims:

1. A device in combination with and for guiding a liquid into a liquid storage can having a top and a top opening, the top having a rim about the opening, the rim having an upwardly facing shoulder surrounding an upwardly facing channel with an upwardly extending inner lip lining an inner side of said channel surrounding said top opening comprising:

a conical wall portion open at a top end and having a smaller opening at a bottom end leading into the top opening of said can;

an annular flange portion on the wall portion bottom end, the flange portion having a downwardly facing engaging member extending into said upwardly facing channel surrounding the top opening of said can;

said flange portion having a first horizontal shoulder with a bottom surface in contact with the inner lip of said upwardly facing channel extending inwardly and having an annular end terminating above said lip and the opening into said can;

said flange portion also having a second horizontal shoulder extending outwardly with a bottom surface in contact with the paint can rim shoulder;

a top surface of said first horizontal shoulder being horizontal adjacent said annular end of said first horizontal shoulder; and an outer edge of said second horizontal shoulder extending vertically upwardly to join said conical wall portion of said device.

2. The combination of claim 1, wherein the liquid storage can is a paint can, and the liquid is paint.

3. The device of claim 1, wherein the wall portion has at least one grasping extension.

4. The device of claim 1, wherein the wall portion has a pair of grasping extensions.

5. The combination of claim 1 in which the top surface of said first horizontal shoulder joins said conical portion of said device in a curve.

* * * * *